US010968699B2

(12) United States Patent
Anderson et al.

(10) Patent No.: US 10,968,699 B2
(45) Date of Patent: Apr. 6, 2021

(54) LOBED ROTOR WITH CIRCULAR SECTION FOR FLUID-DRIVING APPARATUS

(71) Applicant: Roper Pump Company, Commerce, GA (US)

(72) Inventors: Tyson Bentley Anderson, Watkinsville, GA (US); Edmond Tate Coghlan, Talmo, GA (US); Zachariah Paul Rivard, Nicholson, GA (US)

(73) Assignee: Roper Pump Company, Commerce, GA (US)

( * ) Notice: Subject to any disclaimer, the term of this patent is extended or adjusted under 35 U.S.C. 154(b) by 509 days.

(21) Appl. No.: 15/601,193

(22) Filed: May 22, 2017

(65) Prior Publication Data

US 2018/0223598 A1 Aug. 9, 2018

Related U.S. Application Data

(60) Provisional application No. 62/454,980, filed on Feb. 6, 2017.

(51) Int. Cl.
*F01C 1/10* (2006.01)
*F03C 2/00* (2006.01)
(Continued)

(52) U.S. Cl.
CPC ..... *E21B 4/02* (2013.01); *F01C 21/02* (2013.01); *F04C 2/107* (2013.01); *F04C 2/1071* (2013.01);
(Continued)

(58) Field of Classification Search
CPC ..... F04C 2/08; F04C 2/107; F04C 2/1071; F04C 2/1075; F04C 2230/10;
(Continued)

(56) References Cited

U.S. PATENT DOCUMENTS 3,539,279 A * 11/1970 Rider ..... F04C 2/1071 418/48
3,938,915 A 2/1976 Dlofsson
(Continued)

FOREIGN PATENT DOCUMENTS

AU 2007221859 A1 4/2009
EP 0265521 A1 5/1988
(Continued)

*Primary Examiner* — Theresa Trieu
(74) *Attorney, Agent, or Firm* — Snyder, Clark, Lesch & Chung, LLP

(57) ABSTRACT

A fluid displacement apparatus includes a stator section with a rotor therein. The stator section includes a cylindrical casing, a helically-convoluted chamber section within the cylindrical casing, and a rigid sleeve within the cylindrical casing and separate from the helically-convoluted chamber section. The rigid sleeve includes a circular internal bore. The rotor is rotatably disposed within the cylindrical casing. The rotor includes a helically-lobed section disposed within the helically-convoluted chamber section, and a circular cylinder section disposed within the rigid sleeve. The circular cylinder section provides a fluid passageway between the rigid sleeve and the circular cylinder section. Side loads from the rotor are distributed along a contact line at any point of rotation of the circular cylinder section within the rigid sleeve.

20 Claims, 8 Drawing Sheets

(51) Int. Cl.

| | |
|---|---|
| ***F03C 4/00*** | (2006.01) |
| ***F04C 2/00*** | (2006.01) |
| ***E21B 4/02*** | (2006.01) |
| ***F04C 2/107*** | (2006.01) |
| ***F01C 21/02*** | (2006.01) |
| *F04C 13/00* | (2006.01) |
| *F04C 2/08* | (2006.01) |

(52) U.S. Cl.
CPC ..... *F04C 2/1075* (2013.01); *F04C 2/08* (2013.01); *F04C 13/008* (2013.01); *F04C 2230/10* (2013.01); *F04C 2230/23* (2013.01); *F04C 2230/60* (2013.01); *F04C 2230/80* (2013.01); *F04C 2230/90* (2013.01); *F04C 2240/50* (2013.01); *F04C 2240/56* (2013.01); *F04C 2240/60* (2013.01); *F04C 2240/605* (2013.01)

(58) Field of Classification Search
CPC ..... F04C 2230/23; F04C 2230/60; F04C 2230/80; F04C 2230/90; F04C 2240/50; F04C 2240/56; F04C 2240/60; F04C 2240/605; E21B 4/02; F01C 21/02
USPC ..... 418/48, 152–153, 178–179
See application file for complete search history.

(56) References Cited

U.S. PATENT DOCUMENTS

| | | | | |
|---|---|---|---|---|
| 4,405,269 | A * | 9/1983 | Hertzler | B23B 51/10 408/211 |
| 4,482,305 | A | 11/1984 | Natkai et al. | |
| 4,558,991 | A | 12/1985 | Barr | |
| 4,923,376 | A | 5/1990 | Wright | |
| 5,662,463 | A | 9/1997 | Mirzoev et al. | |
| 5,772,820 | A | 6/1998 | Schoch, Jr. et al. | |
| 6,170,572 | B1 | 1/2001 | Fulbright et al. | |
| 6,336,796 | B1 * | 1/2002 | Cholet | F04C 2/1071 418/48 |
| 6,729,391 | B2 * | 5/2004 | Hill | F04C 13/008 166/105 |
| 6,881,045 | B2 * | 4/2005 | Zitka | F04C 2/1071 418/48 |
| 7,696,275 | B2 * | 4/2010 | Slay | B82Y 30/00 524/445 |
| 8,007,259 | B2 | 8/2011 | Kreidl et al. | |
| 8,613,608 | B2 | 12/2013 | Ree | |
| 8,784,085 | B2 | 7/2014 | Hayashimoto | |
| 8,967,985 | B2 | 3/2015 | Coghlan, III et al. | |
| 8,992,195 | B2 | 3/2015 | Hossain et al. | |
| 9,404,493 | B2 | 8/2016 | Samad et al. | |
| 9,522,443 | B2 | 12/2016 | Bowar et al. | |
| 2006/0073032 | A1 * | 4/2006 | Parrett | F04C 2/1071 418/48 |
| 2013/0048384 | A1 | 2/2013 | Jarvis et al. | |
| 2014/0119681 | A1 * | 5/2014 | Braun | F16C 32/0629 384/114 |
| 2015/0144329 | A1 | 5/2015 | Schultz et al. | |
| 2016/0348508 | A1 * | 12/2016 | Purcell | F04C 2/1071 418/48 |

FOREIGN PATENT DOCUMENTS

| | | | |
|---|---|---|---|
| WO | 2015047405 | A1 | 4/2015 |
| WO | 2015123288 | A2 | 8/2015 |

* cited by examiner

LOBED ROTOR WITH CIRCULAR SECTION FOR FLUID-DRIVING APPARATUS

CROSS-REFERENCE TO RELATED APPLICATION

This application claims priority under 35 U.S.C. § 119, based on U.S. Provisional Patent Application No. 62/454,980 filed Feb. 6, 2017, the disclosure of which is hereby incorporated by reference herein.

BACKGROUND OF THE INVENTION

This invention relates generally to motors, and more particularly, to hydraulic motors and gear pumps.

Today's downhole drilling motors usually are of the convoluted helical gear expansible chamber construction because of their high power performance and relatively thin profile. In these motors, drilling fluid is pumped through the motor to operate the motor and is used to wash the chips away from the drilling area. These motors can provide direct drive for a drill bit and can be used in directional drilling or deep drilling. In the typical design, the working portion of the motor includes an outer housing having an internal multi-lobed stator mounted therein and a multi-lobed rotor disposed within the stator. Generally, the rotor has one less lobe than the stator to facilitate pumping rotation. The rotor and stator both have helical lobes and their lobes engage to form sealing surfaces which are acted on by the drilling fluid to drive the rotor within the stator. In the case of a helical gear pump, the rotor is turned by an external power source to facilitate pumping of the fluid. In other words, a downhole drilling motor uses pumped fluid to rotate the rotor, while the helical gear pump turns the rotor to pump fluid.

DETAILED DESCRIPTION OF THE PREFERRED EMBODIMENTS

The following detailed description refers to the accompanying drawings. The same reference numbers in different drawings may identify the same or similar elements.

Applications of a stator and a rotor described herein include a downhole drilling motor to be used in an oil or gas well, or a utility bore hole. The downhole drilling motor may be a hydraulic motor that uses drilling mud flowing therethrough to create rotary motion that powers a drill bit or other tool. Part of the stator section has at least one sleeve. The sleeve is sized to allow the rotor to rotate during operation, but also to support the rotor. The rotor is uniquely configured to include a circular cylinder section that contacts the sleeve. When a side load is applied to the rotor, the circular section of the rotor contacts the sleeve with a distributed force to reduce rotational drift of the rotor and extend the stator life, in contrast with a lobed rotor section that would cause a point load against the sleeve.

According to implementations described herein, a fluid displacement apparatus, such as a hydraulic motor or pump may include a stator section with a rotor therein. The stator section may include a cylindrical casing, a helically-convoluted chamber section within the cylindrical casing, and a rigid sleeve within the cylindrical casing and separate from the helically-convoluted chamber section. The rigid sleeve may include a circular internal bore. The rotor may be rotatably disposed within the cylindrical casing. The rotor may include a helically-lobed section disposed within the helically-convoluted chamber section and a circular cylinder section disposed within the rigid sleeve. The circular cylinder section provides a fluid passageway between the rigid sleeve and the circular cylinder section. Side loads from the rotor may be distributed along a contact line at any point of rotation of the circular cylinder section within the rigid sleeve.

In one implementation, the circular cylinder section of the rotor may be machined as an integral piece with the helically-lobed section. According to another implementation, the circular cylinder section may be formed over a rotor portion with helical lobes. For example, the circular cylinder section may include a first sleeve half and a second sleeve half joined over the rotor portion. The sleeve halves may be welded together around the rotor portion. Additionally, or alternatively, the sleeve halves may be welded to the rotor portion.

Figure 1:
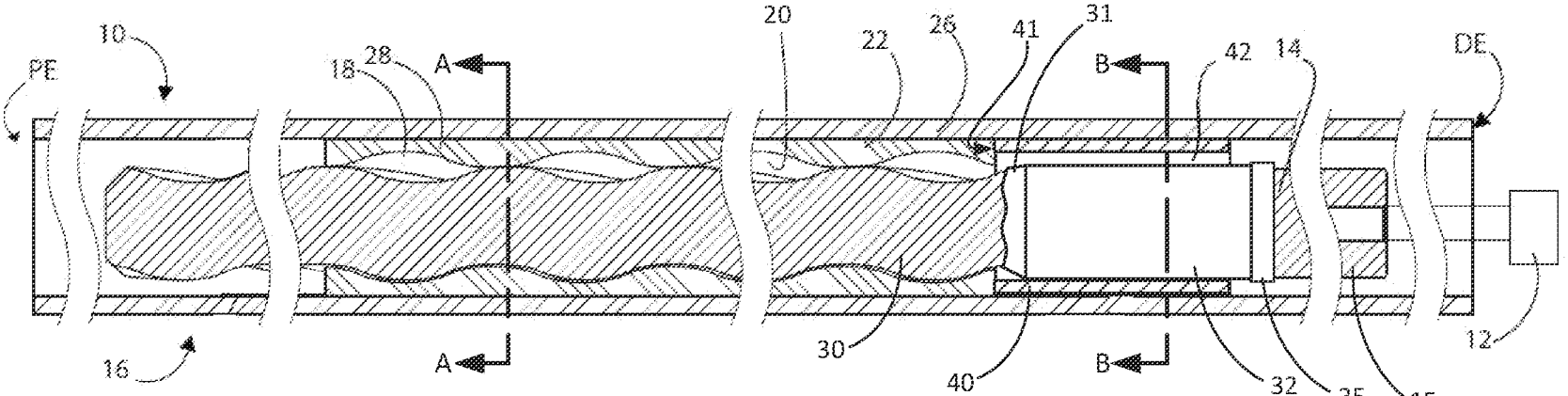
FIG. 1 is a partial, longitudinal cut-way view of an exemplary stator and rotor, according to an implementation described herein.

FIG. 1 depicts an exemplary embodiment of a hydraulic motor or pump 10 that has its principal use as a drilling motor for downhole oil well or slurry applications. The motor or pump 10 is shown partially cut away showing a drill bit or similar power device 12 attached to a rotor 14 (at a distal or working end DE) extended through a stator 16. Power device 12 may be attached to a base portion 15 of rotor 14. Rotor 14 may include an elongated helically lobed section 30 and at least one circular cylinder section 32. Stator 16 may also include a helically lobed structure having, for example, at least one more lobe than in helically lobed section 30, which creates gaps 18 between the rotor 14 and stator 16 along the longitudinal length therebetween. These gaps 18 progressively move along the length between the rotor 14 and stator 16 as rotor 14 rotates within stator 16, and progressively move fluid in the gaps from one end of rotor 14 to the other end with the rotation.

Stator 16 may include a tubular elastomer stator section 22 housed within a cylindrical outer housing or stator casing 26 and at least one sleeve 40 within the casing 26 at a location proximate circular cylinder section 32. By way of example, FIG. 1 shows tubular elastomer stator section 22 with a sleeve 40 adjacent one end of section 22. In other implementations, sleeves 40 may be used adjacent to each end of section 22. The stator 16 defines a helically convoluted chamber 20 (FIG. 2) about a longitudinal portion of rotor 14 that corresponds to elastomer stator section 22. Elastomer stator section 22 includes an elastically deformable liner 28 made of an elastomeric material (e.g., rubber, plastic, etc.). In the configuration of FIG. 1 deformable liner 28 fits tightly around helically lobed section 30 over part of its length.

Figure 11A:
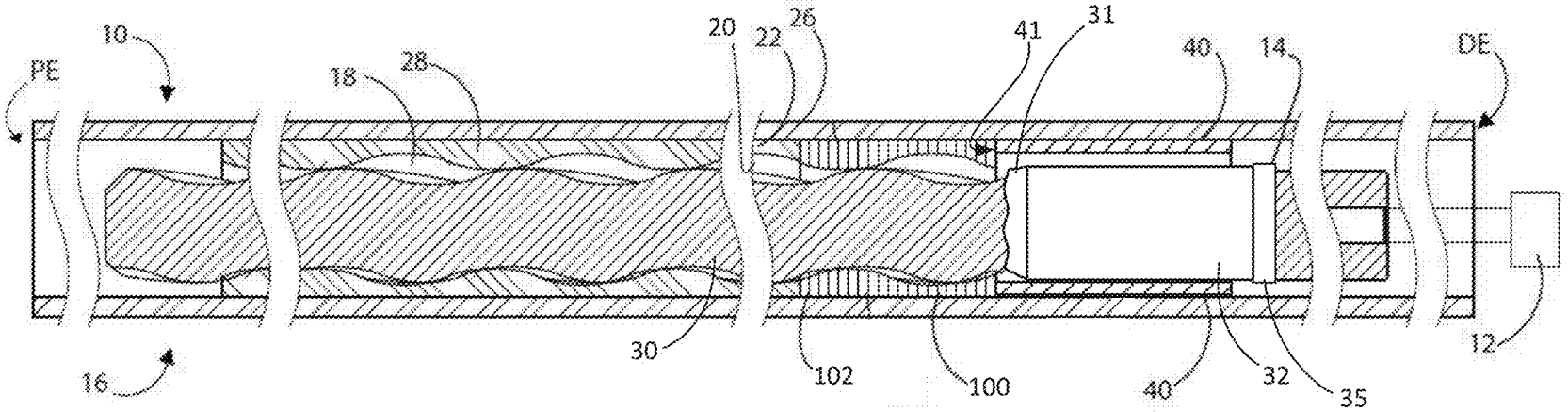
FIGS. 11A and 11B are partial, longitudinal cut-way views of exemplary stator and rotor combinations, according to other implementations described herein

In another configuration, all or part of elastomer stator section 22 may be replaced with one or more profiled rigid sections that are shaped like the elastomer stator section 22, but have no rubber. For example, as shown in FIG. 11A, a helical rigid section 100 may be included between stator section 22 and sleeve 40. In one implementation, helical rigid section 100 may be formed from multiple disks 102 with apertures oriented to match the lobed profile of stator section 22. A slight difference in rotation between identical axially aligned disks 102 may form small steps between each disk along the length of helically convoluted chamber 20. In another implementation, helical rigid section 100 may be formed from a single rigid piece with the lobed helical profile therein. Helical rigid section 100 preferably has a slightly larger major diameter than that of rotor 14, such that helical rigid section 100 does not fit as tightly around helically lobed section 30 as elastomer stator section 22.

Figure 11B:
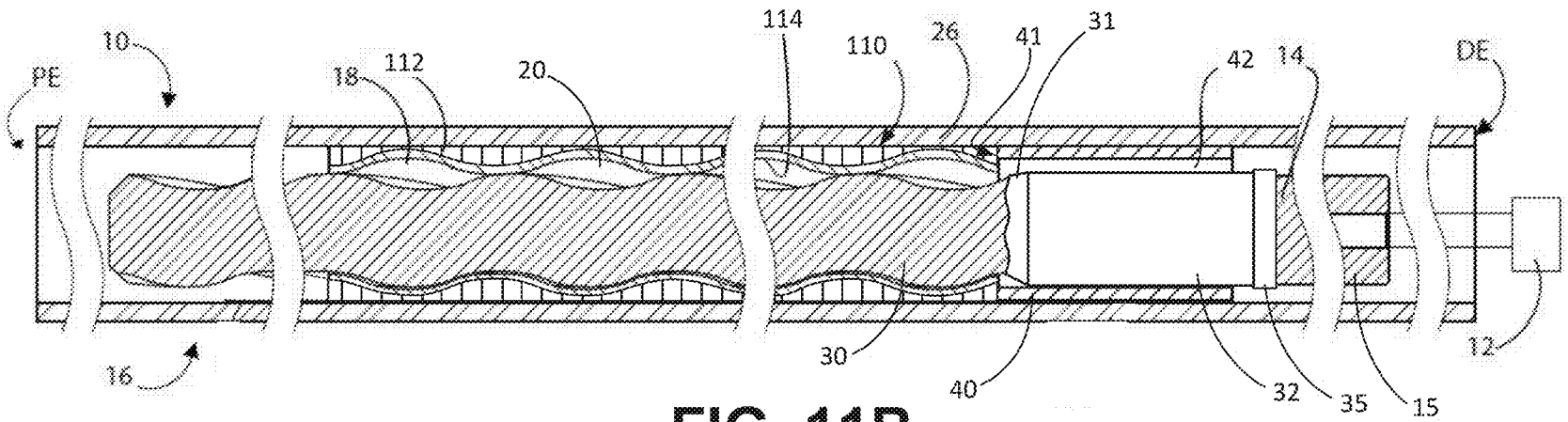

In still another configuration, all or part of elastomer stator section 22 of FIG. 1 may be replaced with one or more hybrid rigid/elastomer sections that are shaped with a lobed profile like elastomer stator section 22. For example, as shown in FIG. 11B, a hybrid section 110 may replace stator section 22 of FIG. 1. Hybrid section 110 may include a rigid support section 112 lined on an interior surface with an elastomeric layer 114. Rigid support section 112 may be made, for example, from disks similar to disks 102 (FIG. 11A). Elastomeric layer 114 applied over steps between the disks in rigid support section 112, as shown in FIG. 11B, may provide a smooth surface along helically convoluted chamber 20. In still other configurations, additional stator sections and combinations of stator sections (e.g., rigid, elastomeric, or combinations thereof) may be included within stator casing 26 along with one or more sleeve 40. For example, two or more of elastomer stator section 22 (FIG. 1), helical rigid section 100 (FIG. 11A), and hybrid section 110 (FIG. 11B) may be aligned in different combinations to form continuous helically convoluted chamber 20 with a sleeve 40 at one or both ends.

Figure 2:
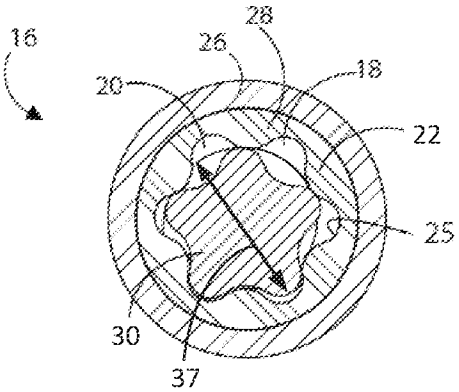
FIG. 2 is a transverse cross sectional view of the stator along line A-A of FIG. 1 showing an elastically deformable liner within a stator casing and housing a helical portion of the rotor therein.

FIG. 2 depicts the stator 16 in traverse cross section, showing the elastically deformable liner 28 defining helically convoluted chamber 20 within the stator casing 26 and housing helically lobed section 30 of rotor 14 therein. While not being limited to a particular theory, liner 28 is shown in FIG. 1 as extended between the chamber 20 and the stator casing 26. As can be seen in FIG. 1, the elastically deformable liner 28 is bonded to the stator casing 26. A circumference about the radial extension of the lobes in helically lobed section 30 may define the major diameter 37 (FIG. 2) of helically lobed section 30.

Figure 3:
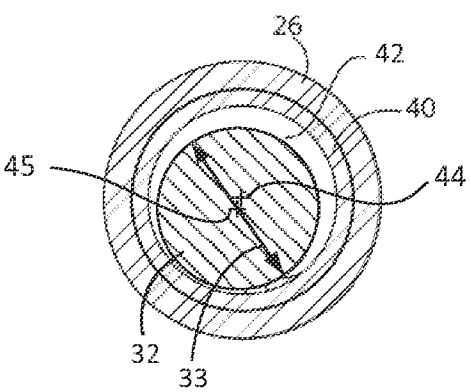
FIG. 3 is a transverse cross sectional view of the stator along line B-B of FIG. 1 showing an elastically deformable liner within a stator casing and housing a circular cylinder portion of the rotor therein.

FIG. 3 depicts rigid sleeve 40 in traverse cross section, showing a fluid passageway 42 within stator casing 26 and housing circular cylinder section 32 of rotor 14 therein. In one implementation, sleeve 40 is formed of a metallic material. In other implementations, sleeve 40 may include another rigid material, such as a plastic material or a composite material. Sleeve 40 may be secured to the inside surface of stator casing 26 by, for example, welding, fusing, soldering, brazing, sintering, diffusion bonding, mechanical fastening, or an adhesive bond. As shown, for example, in FIG. 1, circular cylinder section 32 is located substantially within sleeve 40. More particularly, when rotor 14 is installed in stator casing 26, circular cylinder section 32 does not extend from within sleeve 40 longitudinally beyond an end 41 of sleeve 40 that is adjacent stator section 22. However, when rotor 14 is installed in stator casing 26, circular cylinder section 32 may extend from within sleeve 40 longitudinally beyond the end of sleeve 40 that is opposite end 41.

Figure 4:
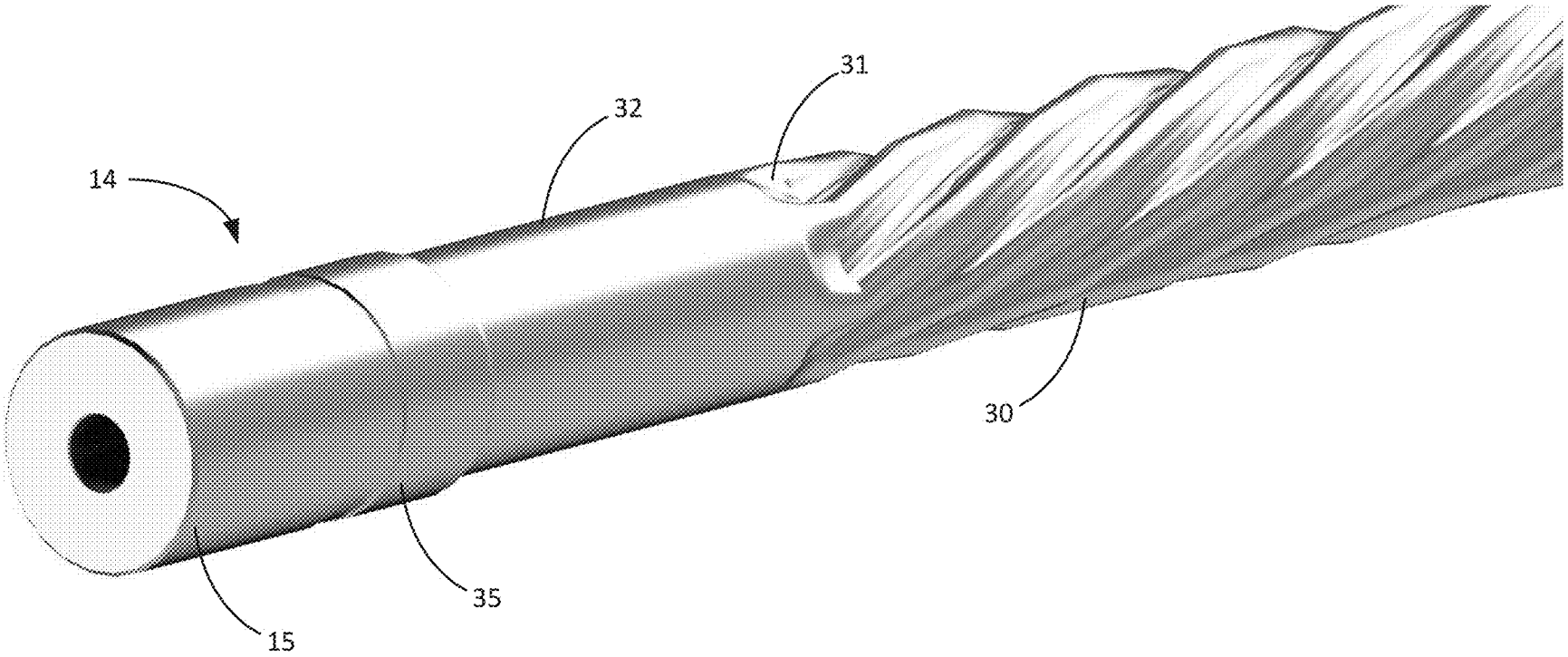
FIG. 4 is a schematic perspective diagram illustrating a portion of the rotor of FIG. 1, according to an implementation described herein.

FIG. 4 shows a perspective view of rotor 14 including a portion of helically lobed section 30 and a retrofit circular cylinder section 32. In one implementation, rotor 14 may include a transition section 31 between helically lobed section 30 and circular cylinder section 32. Transition section 31 may include a tapering or gradual change longitudinally between helically lobed section 30 and circular cylinder section 32. According to an implementation, as shown in FIG. 1, transition section 31 may be positioned within sleeve 40, so as not to contact stator section 22. As further shown in FIG. 4, in one implementation, circular cylinder section 32 may also include an overlapping section 35 with base portion 15. As shown, for example, in FIG. 1, overlapping section 35 may be located outside sleeve 40. The diameter of overlapping section 35 may be larger than, for example, the major diameter of helically lobed section 30.

Sleeve 40 may provide added support of the rotor 14 during operation. As shown in FIGS. 1 and 3, the inner diameter of sleeve 40 is larger than the outer diameter 33 of circular cylinder section 32. Sleeve 40 forms a cylindrical chamber section or passageway 42 around circular cylinder section 32. Sleeve 40 and circular cylinder section 32 are sized so that during operation, rotor 14 orbit causes circular cylinder section 32 to contact the inner surface of sleeve 40, thereby supporting rotor 14. Sleeve 40 may have an axis 44, and rotor 14 (including circular cylinder section 32) may have an axis 45. Axis 44 and axis 45 may be essentially parallel when rotor 14 is installed in stator casing 26. As shown in FIG. 3, axis 45 may be offset from axis 44 such that axis 45 generally orbits around axis 44 as rotor 14 rotates within stator casing 26. The geometry of circular cylinder section 32 and sleeve 40 is such that circular cylinder section 32 contacts the inner surface of sleeve 40 along a line (i.e., a line parallel to an axis 44 of sleeve 40) as circular cylinder section 32 orbits within rigid sleeve 40. Thus, side loads from rotor 14 are distributed along a contact line at any point of rotation of circular cylinder section 32 within sleeve 40, rather than at a particular point, which could cause undesirable wear and shorten the life of rotor 14. More specifically, use of circular cylinder section 32 within rigid sleeve 40 prevents the highly concentrated forces of a point contact from the contour of a helical lobe (e.g., such as in helically lobed section 30) against the inner surface of sleeve 40.

Figure 5:
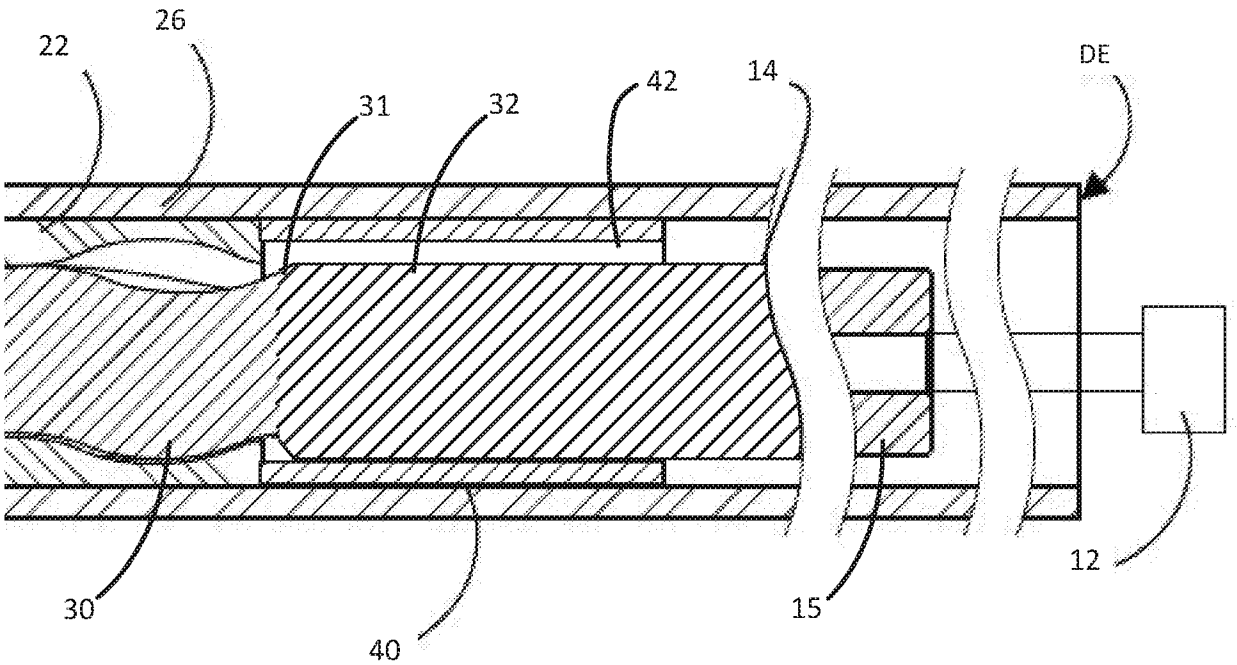
FIG. 5 is a partial, longitudinal cross-sectional view of an exemplary stator and a circular cylinder portion of the rotor that is machined as an integral piece with a helically-lobed section, according to an implementation described herein.

Circular cylinder section 32 may be applied to rotor 14 as new construction or as a retrofit for an existing lobed rotor. FIG. 5 shows a cross-sectional view of rotor 14 with circular cylinder section 32 machined as an integral piece with helically lobed section 30. In other words, helically lobed section 30 and circular cylinder section 32 may be a unitized element forming rotor 14. In the configuration of FIG. 5, circular cylinder section 32 may be a solid circular cylinder. In one implementation, a transition region 31 may be included between helically lobed section 30 and circular cylinder section 32.

Figure 6A:
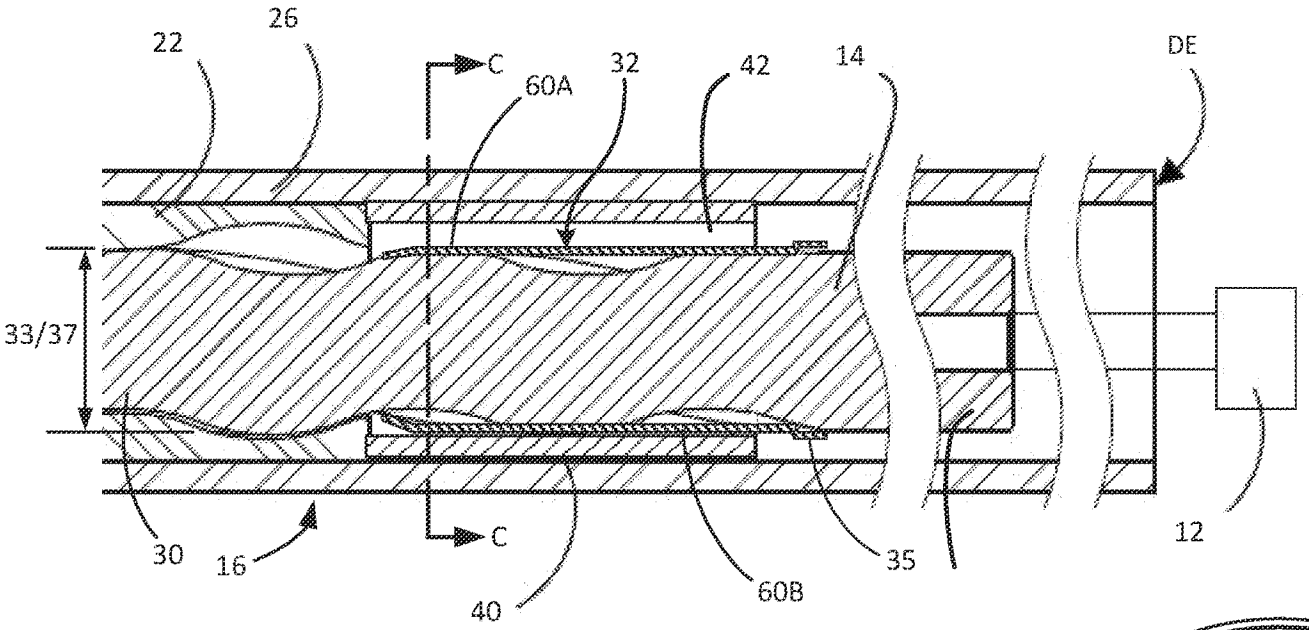
FIG. 6A is a partial, longitudinal cross-sectional view of an exemplary stator and retrofit circular cylinder portion of the rotor, according to an implementation described herein.
Figure 6B:
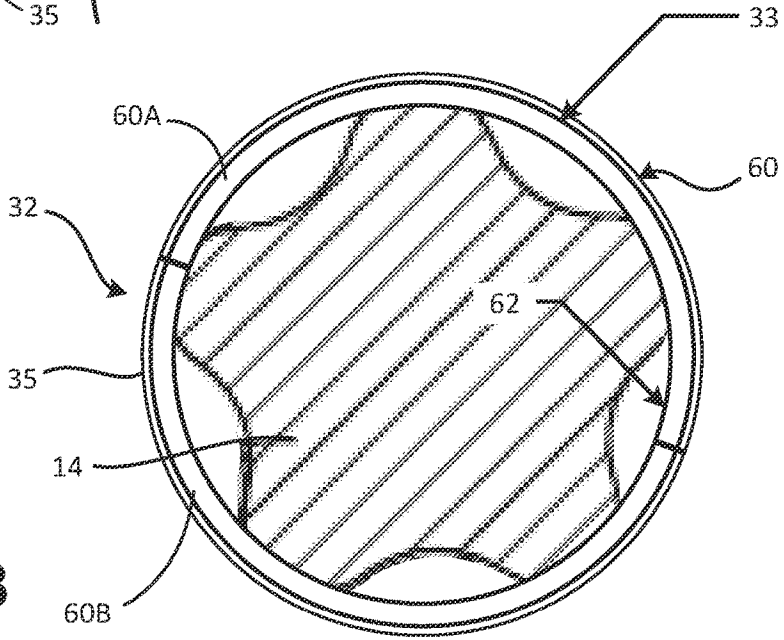
FIG. 6B is a transverse cross sectional view of the rotor along line C-C of FIG. 6A.
Figure 7:
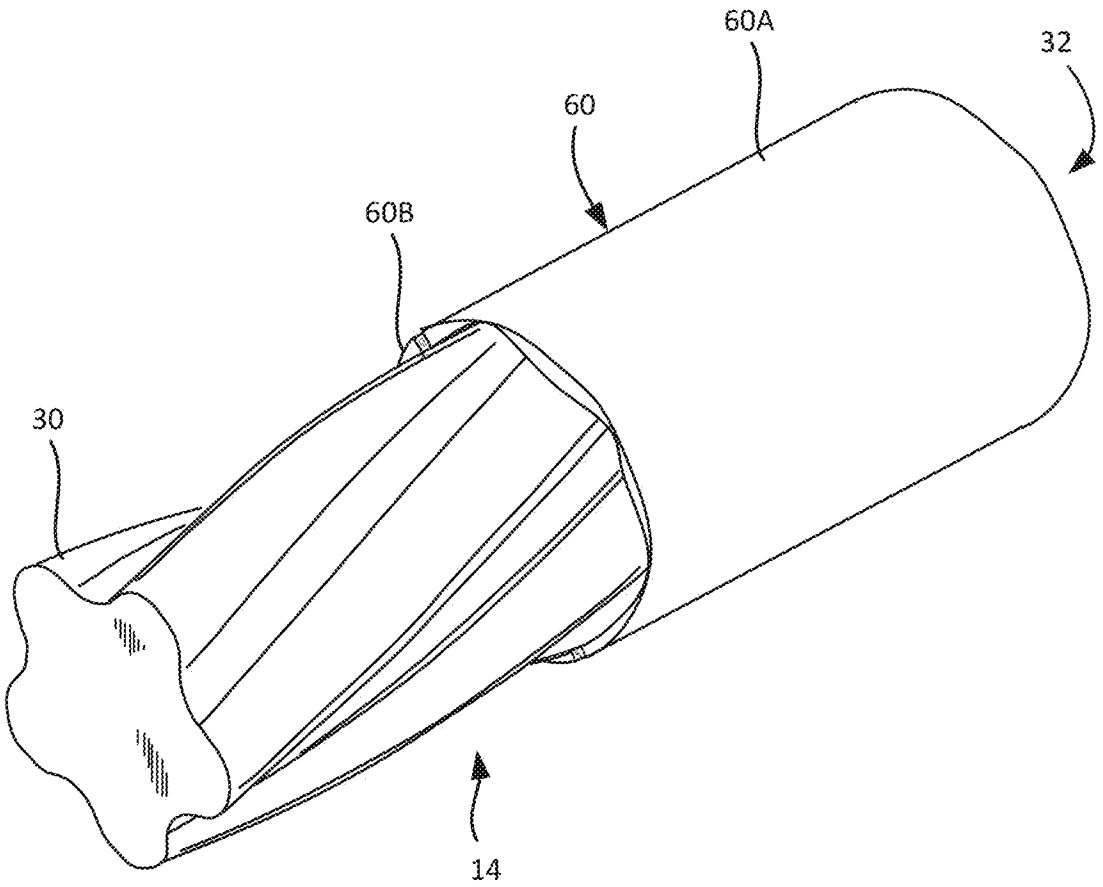
FIG. 7 is a perspective assembly view of a retrofit circular cylinder portion of the rotor, according to an implementation described herein.

FIG. 6A shows a cross section of a cylinder shell 60 that may be applied over a portion of an existing lobed rotor profile to form circular cylinder section 32. FIG. 6B shows a transverse cross-sectional view of rotor 14 along line C-C of FIG. 6A. FIG. 7 shows a perspective view of a retrofit assembly to form circular cylinder section 32. Referring collectively to FIGS. 6A, 6B, and 7, cylinder shell 60 may be a two-piece component (e.g., halves 60A and 60B) selected for a desired diameter (e.g., to match the major diameter of the existing profile for helically lobed section 30).

A portion of rotor 14 may be machined down to accommodate a thickness of cylinder shell 60, such that when halves 60A and 60B are applied over rotor 14, the outer diameter 33 of cylinder shell 60 may be substantially equal to major diameter 37 of helically lobed section 30. Halves 60A and 60B may be joined together around rotor 14 using welding or another joining technique. In some implementations, one or both of halves 60A and 60B may be attached to rotor 14 using, for example, adhesives, spot welds, or another technique.

Halves 60A and 60B may include the same material or a different material than the material of rotor 14. In some implementations, if the material of halves 60A and 60B is different than the material of the existing rotor 14, halves 60A and 60B may include a material suitable for bonding to rotor 14 so that cylinder shell 60 may be secured to rotor 14. In other implementations, halves 60A and 60B may not be bonded to rotor 14, but may be mechanically constrained from rotating separately from rotor 14. For example, an interference fit may be used between rotor 14 and cylinder shell 60 and/or helical protuberances along inner surfaces of halves 60A and 60B may be used to prevent independent rotation of rotor 14 and cylinder shell 60. In still other implementations, halves 60A and 60B may be secured to each other, but not attached to rotor 14, such that cylinder shell 60 may rotate independently from rotor 14.

Figure 8:
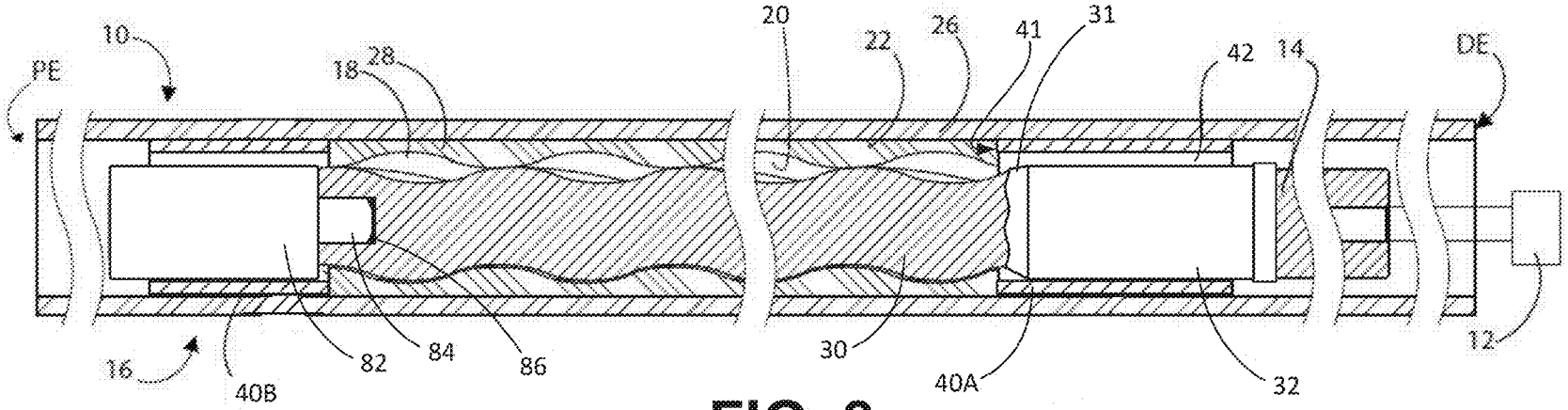
FIG. 8 is a partial, longitudinal cut-way view of an exemplary stator and rotor, according to another implementation described herein.

FIG. 8 shows a motor or pump 10 similar to FIG. 1, but with a two rigid sleeves 40A and 40B installed at opposite ends (distal end, DE and proximal end, PE) of stator casing 26 with stator section 22 in between. In the configuration of FIG. 8, rotor 14 may include circular cylinder section 32 configured to align with sleeve 40A and a circular cylinder section 82 configured to align with sleeve 40B. Circular cylinder section 82 may include the same circular cross-section and outside diameter described above for circular cylinder section 32. However, in one implementation, circular cylinder section 82 may be affixed as a separate piece at the end of rotor 14.

Figure 9:
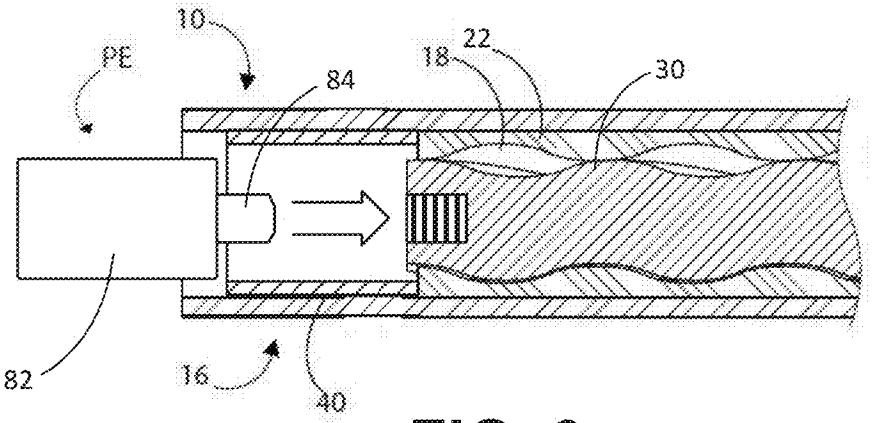
FIG. 9 is a partial assembly view of the exemplary stator and rotor of FIG. 8.

FIG. 9 shows a partially assembly view of circular cylinder section 82 in FIG. 8. In the configuration of FIGS. 8 and 9, rotor 14 (including circular cylinder section 32) may be inserted from distal end DE through sleeve 40A and stator section 22. Circular cylinder section 82 may then be inserted through proximal end PE and coupled to rotor 14 after helically lobed section 30 is inserted past stator section 22. Rotor 14 may be cut and/or machined to a required length as either new construction or a retrofit procedure. Particularly, when rotor 14 is inserted from the distal end into stator casing 26, helically lobed section 30 may be sized to extend past stator section 22 and slightly into sleeve 40B, as shown in FIG. 9. The exposed end of helically lobed section 30 may include a threaded cavity 86 to enable coupling of circular cylinder section 82. Circular cylinder section 82 may include, for example, a threaded stem 84 which may be inserted into threaded cavity 86 to secure circular cylinder section 82 to rotor 14. In one implementation, additional pins or locking mechanisms may be used to prevent decoupling of circular cylinder section 82 from rotor 14 when motor or pump 10 is in operation.

Figure 10:
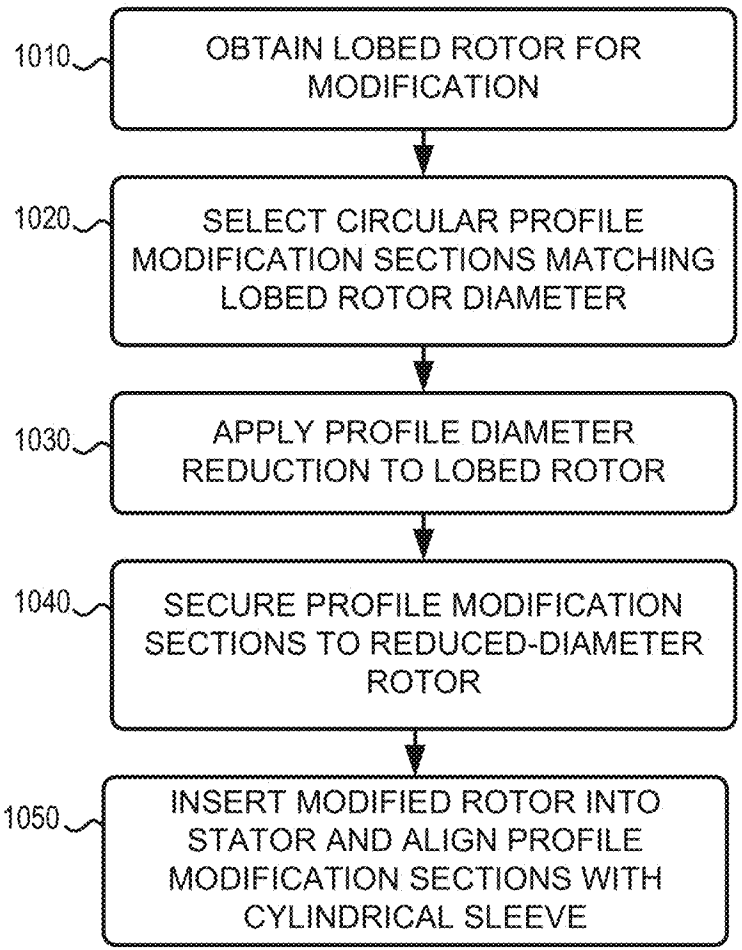
FIG. 10 is a flow diagram of a process for adding a circular cylinder section to a helical rotor, according to an implementation described herein.

FIG. 10 is a flow diagram of a process for adding a circular cylinder section to a helical rotor for a hydraulic motor or pump 10, according to an implementation described herein. Process 1000 may include obtaining a lobed rotor for modification (block 1010). For example, a rotor with an elongated helically lobed section 30 for use in motor or pump 10 may be selected for modification.

Process 1000 may include selecting circular profile modification sections matching a major diameter of the lobed rotor profile (block 1020). For example, for the selected rotor 14, a technician may identify a major diameter of rotor 14. As shown for example in FIG. 6B, cylinder shell 60, including halves 60A and 60B, may be selected to form circular cylinder section 32 with an outer diameter 33 being the same as the major diameter 37 of helically lobed section 30.

Process 1000 may further include performing profile diameter reduction to a portion of the rotor (block 1030). For example, as shown in FIGS. 6A and 6B, tips of the helical lobes of rotor 14 corresponding to circular cylinder section 32 may be ground down or otherwise removed to reduce the major diameter of the helical lobes. The reduced major diameter of rotor 14 may be equal to or slightly less than the inner diameter 62 (FIG. 6B) of cylinder shell 60 (e.g., to provide clearance for securing cylinder shell 60 over the portion of rotor 14).

Process 1000 may also include securing the profile modification sections to the reduced-diameter rotor (block 1040). For example, halves 60A and 60B may be applied over the reduced-diameter portion of rotor 14 (i.e., corresponding to circular cylinder section 32). The halves 60A and 60B may be welded together around the reduced-diameter portion of rotor 14 to form circular cylinder section 32. Additionally, or alternatively, halves 60A and 60B may be welded or bonded to rotor 14.

Process 1000 may further include inserting the modified rotor into a stator and aligning the profile modification sections with a cylindrical sleeve (block 1050). For example, as shown in FIG. 6A, rotor 14 with circular cylinder section 32 may be inserted into stator 16. Circular cylinder section 32 may be positioned within sleeve 40.

Implementations described herein provide a fluid displacement apparatus with a stator section with a rotor therein. The stator section includes a rigid sleeve. The rotor is uniquely configured to include a circular cylinder section that contacts the sleeve. When a side load is applied to the rotor, the circular cylinder section of the rotor contacts the sleeve with a distributed force to reduce rotational drift of the rotor and extend the stator life. The circular cylinder section may be provided with a new construction rotor or as a retrofit over a portion of a helically lobed rotor.

As a retrofit, a cylinder shell with the same major diameter of the rotor is selected. Tips of the lobes of a portion of the rotor may be machined down to forms a reduced-diameter section of the rotor that is nominally smaller than an inner diameter of the cylinder shell. The cylinder shell may be secured to the reduced-diameter section of the helically-lobed rotor to form a circular cylinder section that will contact the sleeve when the rotor is installed in the stator section.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A fluid displacement apparatus, comprising:

a stator section including a cylindrical casing, a helically-convoluted chamber section within the cylindrical casing, and a rigid sleeve within the cylindrical casing and separate from the helically-convoluted chamber section, the rigid sleeve being secured to an inside surface of the cylindrical casing and including a circular internal bore; and a rotor rotatably disposed within the cylindrical casing, the rotor including:

a helically-lobed section disposed within the helically-convoluted chamber section, and a circular cylinder section disposed over a portion of the helically lobed section and within the rigid sleeve, the circular cylinder section providing a fluid passageway between the rigid sleeve and the circular cylinder section, wherein an outer surface of the circular cylinder section contacts an inside surface of the rigid sleeve along a longitudinal line of the rigid sleeve when the rotor rotates within the cylindrical casing.

2. The fluid displacement apparatus of claim 1, wherein the rotor further includes a base section configured for attachment to a power device, wherein the circular cylinder section includes an overlapping portion with the base portion.

3. The fluid displacement apparatus of claim 2, wherein the overlapping portion is located outside of the rigid sleeve.

4. The fluid displacement apparatus of claim 2, wherein the diameter of the overlapping portion has a diameter that is larger than a major diameter of the helically-lobed section.

5. The fluid displacement apparatus of claim 1, wherein the circular cylinder section is machined as an integral piece with the helically-lobed section.

6. The fluid displacement apparatus of claim 1, wherein the circular cylinder section includes a first sleeve half and a second sleeve half joined over a portion of the rotor.

7. The fluid displacement apparatus of claim 6, wherein the first sleeve half and the second sleeve half are welded together around the portion of the rotor.

8. The fluid displacement apparatus of claim 6, wherein the first sleeve half and the second sleeve half are attached to the portion of the rotor.

9. The fluid displacement apparatus of claim 6, wherein the first sleeve half and the second sleeve half include a different material than the helically-lobed section.

10. The fluid displacement apparatus of claim 1, wherein an axis of the circular cylinder section is not concentric with an axis of the circular internal bore.

11. The fluid displacement apparatus of claim 1, wherein the rigid sleeve is adjacent the helically-convoluted chamber section.

12. The fluid displacement apparatus of claim 1, wherein the helically-convoluted chamber section includes one or more of an elastic material and a rigid material.

13. The fluid displacement apparatus of claim 1, wherein the helically-convoluted chamber section includes rigid disks with apertures lined, on an interior surface, with an elastomeric layer to form the helically-convoluted chamber.

14. The fluid displacement apparatus of claim 1, wherein the stator section further includes another rigid sleeve within the stator section, the other rigid sleeve including another circular internal bore, and wherein the rotor further includes another a circular cylinder section within the other rigid sleeve, the other circular cylinder section providing another fluid passageway between the other rigid sleeve and the other circular cylinder section.

15. The fluid displacement apparatus of claim 1, wherein the rigid sleeve and the other rigid sleeve are located on opposite ends of the helically-convoluted chamber section.

16. The fluid displacement apparatus of claim 1, wherein the rigid sleeve is formed from one of a metal or a plastic material.

17. A fluid displacement apparatus, comprising:

a stator section including a cylindrical casing, a helically-convoluted chamber section within the cylindrical casing, and a rigid sleeve within the cylindrical casing and separate from the helically-convoluted chamber section, the rigid sleeve being secured to an inside surface of the cylindrical casing and including a circular internal bore; and a rotor rotatably disposed within the cylindrical casing, the rotor including:

a helically-lobed section disposed within the helically-convoluted chamber section, and a circular cylinder section disposed within the rigid sleeve, the circular cylinder section providing a fluid passageway between the rigid sleeve and the circular cylinder section, wherein an outer diameter of the circular cylinder section matches a major diameter of the helically lobed section.

18. The fluid displacement apparatus of claim 17, wherein the rotor further includes a base section configured for attachment to a power device, wherein the circular cylinder section includes an overlapping portion with the base portion.

19. The fluid displacement apparatus of claim 18, wherein the overlapping portion is located outside of the rigid sleeve.

20. The fluid displacement apparatus of claim 18, wherein the diameter of the overlapping portion has a diameter that is larger than a major diameter of the helically-lobed section.

* * * * *